United States Patent [19]

Betts

[11] 4,176,899

[45] Dec. 4, 1979

[54] QUICK DISCONNECT ELECTRICAL CONNECTOR HAVING DISASSEMBLY FEATURES FOR REFURBISHMENT

[75] Inventor: Edward E. Betts, Escondido, Calif.

[73] Assignee: The United States of America as represented by the Secretary of the Navy, Washington, D.C.

[21] Appl. No.: 953,509

[22] Filed: Oct. 23, 1978

[51] Int. Cl.[2] ..... H01R 13/62

[52] U.S. Cl. ..... 339/45 M; 285/316; 339/91 B

[58] Field of Search ..... 339/45 R, 45 M, 46, 339/89 R, 89 M, 91 R, 91 B; 285/1, 33, 316, DIG. 21

[56] References Cited

U.S. PATENT DOCUMENTS

| | | | |
|---|---|---|---|
| 3,312,928 | 4/1967 | Nava et al. | 339/46 |
| 3,888,559 | 6/1975 | Geib | 339/45 M |

*Primary Examiner*—Neil Abrams

*Attorney, Agent, or Firm*—Richard S. Sciascia; Ervin F. Johnston

[57] ABSTRACT

The invention is an improvement to the female portion of a quick disconnect electrical connector so that said portion can be easily disassembled for refurbishment. The female portion of the quick disconnect is of the type having concentric sleeves which are slidable with respect to one another. The forward ends of the sleeves are adapted to receive a male portion of the mating electrical connector, and the rearward end of one of the sleeves is connected to an elongated element, such as an electrical cable. An annular space is provided at the rearward end portions of an inner and outer adjacent pair of the sleeves, and a compression spring within the annular space is utilized for urging the adjacent sleeves longitudinally apart with respect to one another. The improvement includes a device located within a rear portion of the annular space and releasably connected to the inner adjacent sleeve for stopping rearward movement of the compression spring. The improvement further includes a device located within a forward portion of the annular space and releasably connected to the outer adjacent sleeve for stopping forward movement of the compression spring. With this arrangement the outer sleeve can be slid forwardly and removed entirely from the inner sleeve after release and removal of the stop devices.

5 Claims, 10 Drawing Figures

FIG. 1.
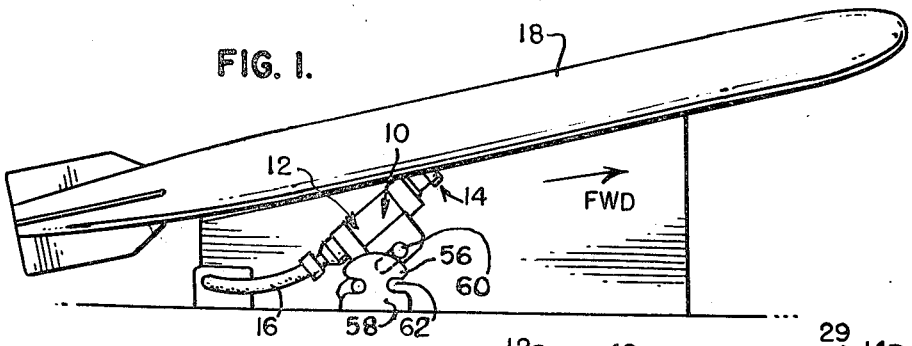
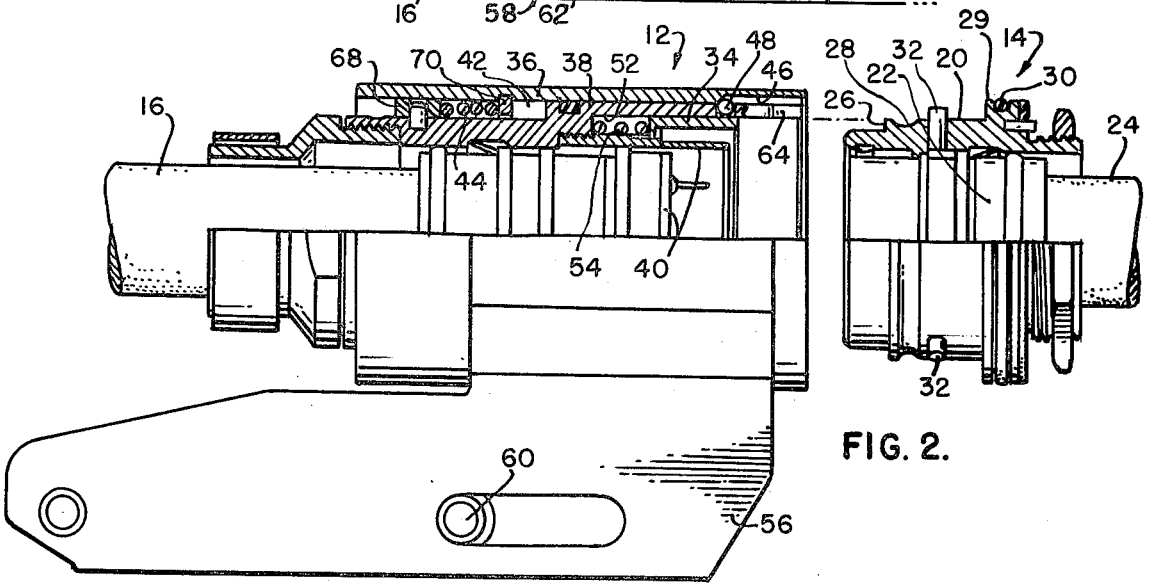
FIG. 2.
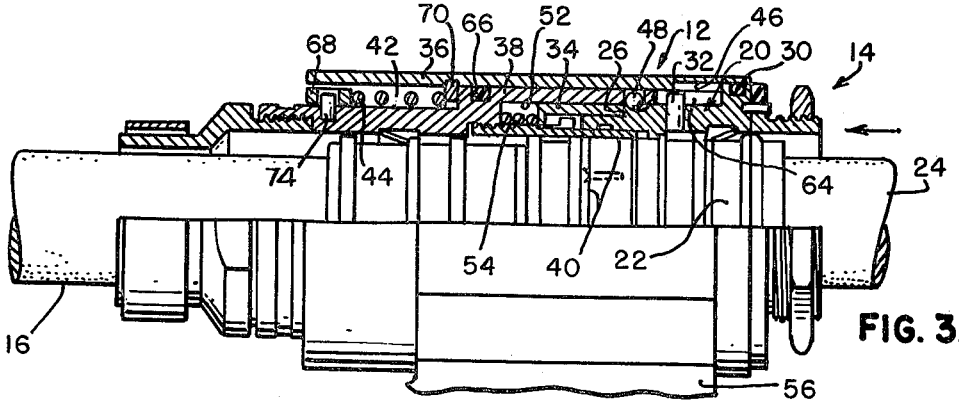
FIG. 3.
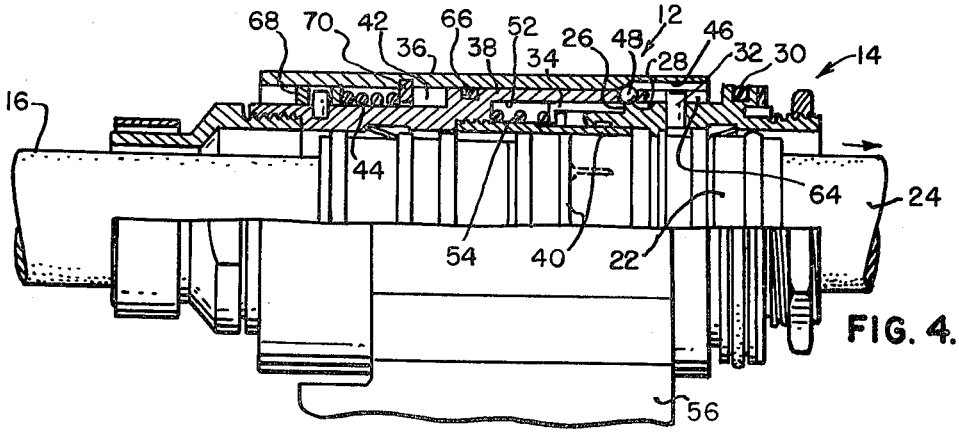
FIG. 4.

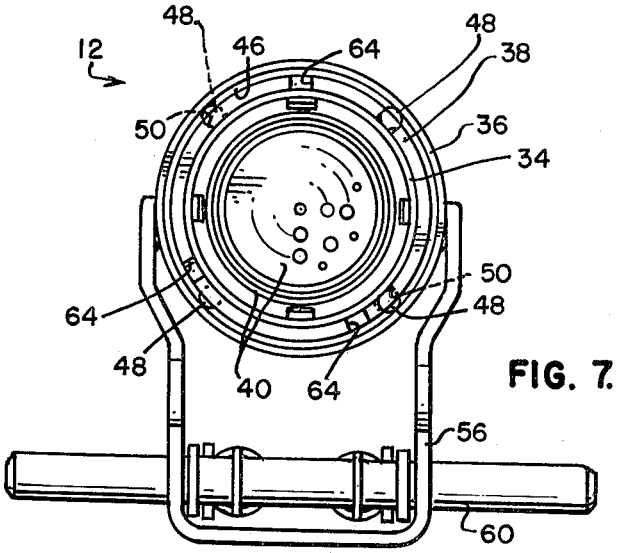
FIG. 7.
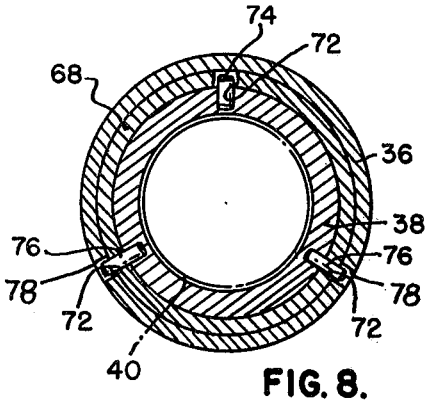
FIG. 8.
FIG. 9.
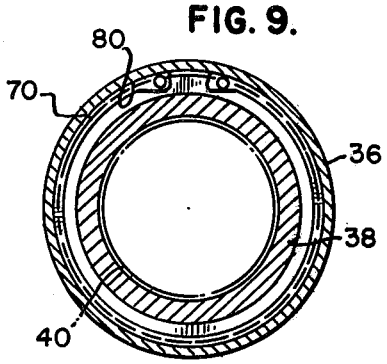
FIG. 10.
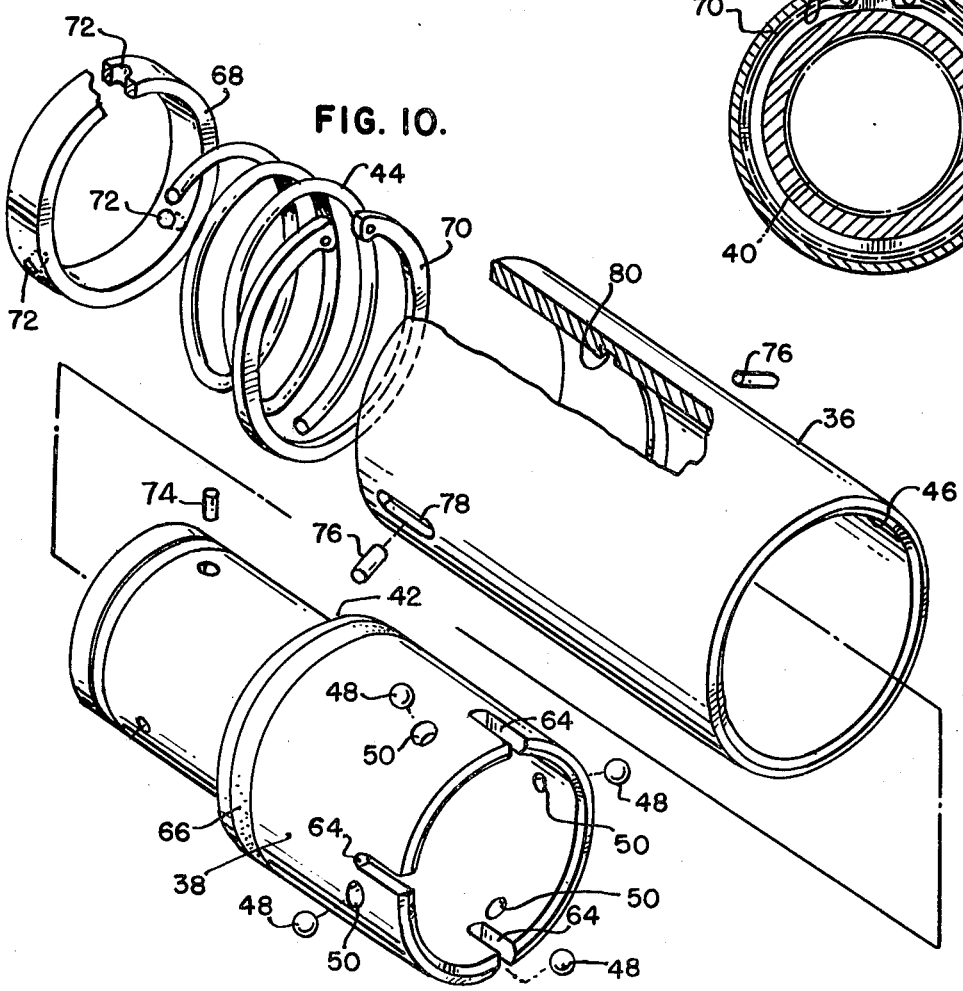

QUICK DISCONNECT ELECTRICAL CONNECTOR HAVING DISASSEMBLY FEATURES FOR REFURBISHMENT

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The invention relates to the female portion of a quick disconnect which has disassembly features for refurbishment purposes.

Quick disconnects have been used extensively by the U.S. Navy as well as other defense agencies for missile launching purposes. These quick disconnects connect power and control functions to the missile via an electrical cable. When the missile is fired the female portion of the quick disconnect and the attendant cable are left behind. It is hoped that the quick disconnect and the cable can be utilized repeatedly for firing many missiles. However, the female portion of the disconnect requires refurbishment in the form of replacement of seals and lubrication after a few firings because of the hostile conditions under which the quick disconnect operates. In the past the particular type of female quick disconnect under consideration had to be discarded after a few uses because its disassembly was impractical for refurbishment purposes. The female portion of the quick disconnect has an outer sleeve which must be removed in order to accomplish the refurbishment.

SUMMARY OF THE INVENTION

The present invention has provided a female portion of a quick disconnect which can be easily disassembled for refurbishment purposes. This has been accomplished by providing an improvement to the female portion of a quick disconnect of the type having concentric sleeves which are slidable with respect to one another. The forward ends of the sleeves are adapted to receive a male portion of the quick disconnect, and the rearward end of one of the sleeves is connected to an elongated element, such as an electrical cable. An annular space is provided at the rearward end portions of an inner and outer adjacent pair of the sleeves, and a compression spring is provided within the annular space for urging the adjacent sleeves longitudinally apart with respect to one another. The improvement includes a device located within the rear portion of the annular space and releasably connected to the inner adjacent sleeve for stopping rearward movement of the compression spring. The improvement further includes a device located within a forward portion of the annular space and releasably connected to the outer adjacent sleeve for stopping forward movement of the compression spring. With this arrangement the outer sleeve can be slid forwardly and removed entirely from the inner sleeve after release and removal of the stop devices. This operation then permits refurbishment of the quick disconnect by the replacement of seals and lubrication.

OBJECTS OF THE INVENTION

An object of the present invention is to provide the female portion of a quick disconnect with disassembly features for refurbishment purposes.

Another object is to provide the female portion of a quick disconnect of the type having adjacent sleeves, wherein the outer sleeve can be removed entirely for enabling replacement of seals, lubrication, and so forth.

Another object is to provide an improved quick disconnect of the type stated in the objects hereinabove, and which can be inexpensively made and used.

These and other objects of the invention will become more readily apparent from the ensuing specification when taken together with the drawings.

DESCRIPTION OF THE DRAWINGS

FIG. 1 is a side view of a quick disconnect which connects a cable to a missile just prior to firing.

FIG. 2 is a side view of the quick disconnect, with the upper half in section, prior to connecting the male portion to the female portion.

FIG. 3 is similar to the illustration in FIG. 2 ecept the male portion of the mating receptacle has been connected within the female portion.

FIG. 4 is similar to FIGS. 2 and 3 except the male portion is being disconnected from the female portion.

FIG. 7 is a view taken along plane VII—VII of FIG. 5.

FIG. 8 is a cross-sectional view taken along plane VIII—VIII of FIG. 5.

FIG. 9 is a cross-sectional view taken along plane IX—IX of FIG. 5.

FIG. 10 is a longitudinally exploded view of the outer and middle sleeves and the components therein of the female portion of the quick disconnect.

DESCRIPTION OF THE PREFERRED EMBODIMENT

Figure 5:
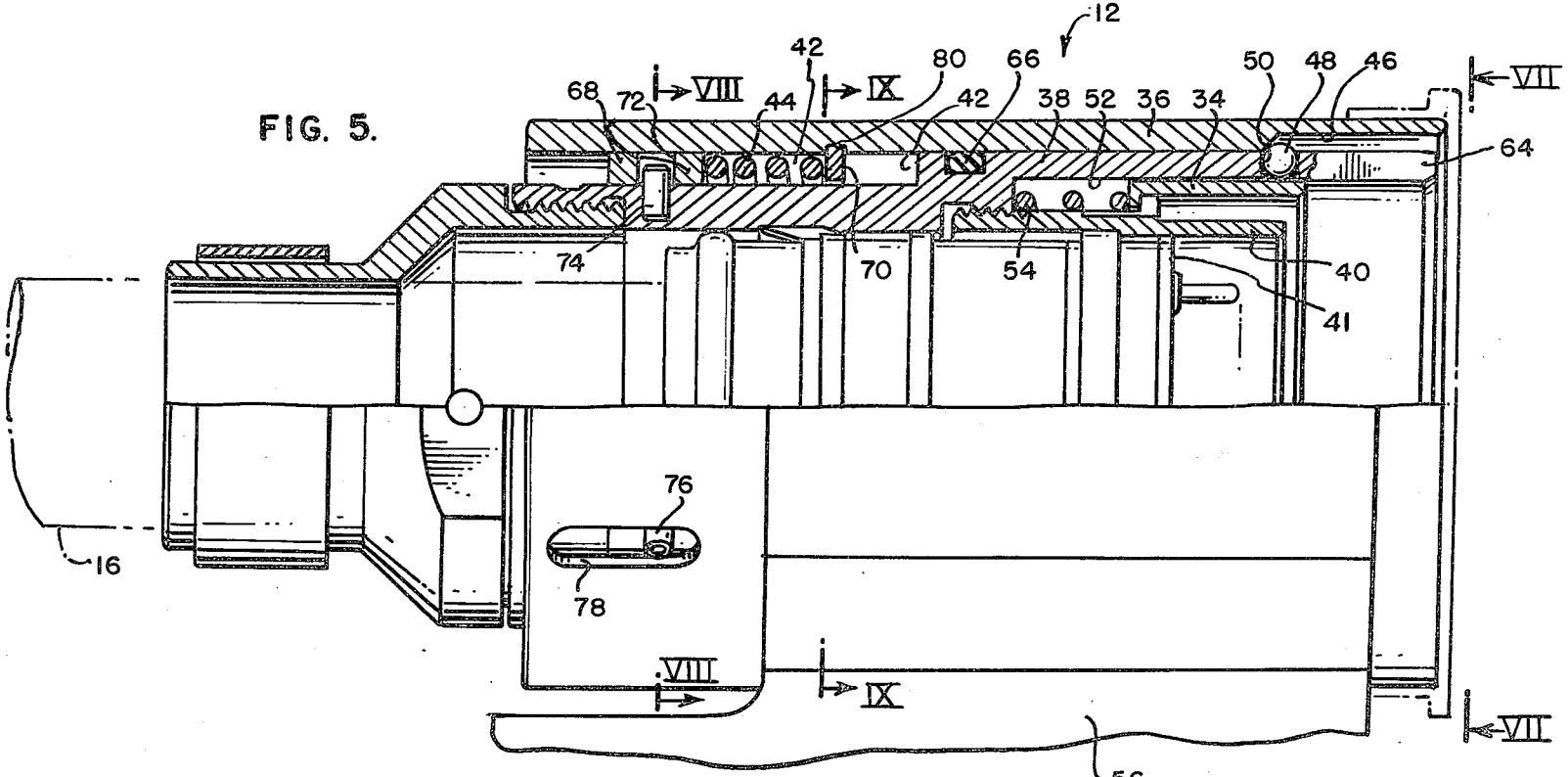
FIG. 5 is a side view of the female portion of the quick disconnect with the top portion cut away to show various details thereof.
Figure 6:
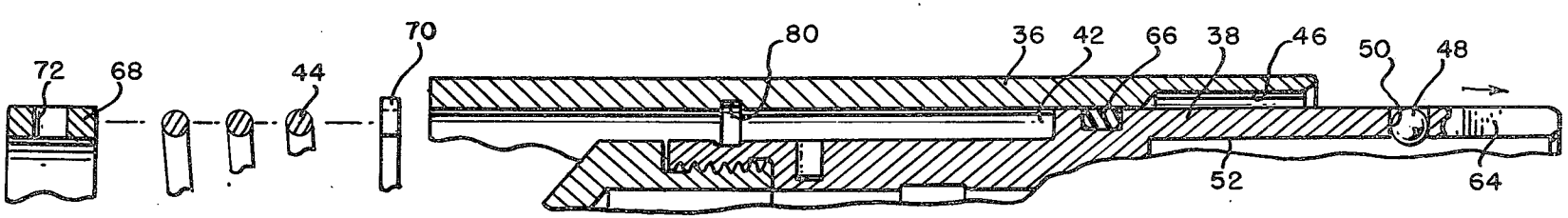
FIG. 6 is a top partially exploded view of the female portion of the quick disconnect.

Referring now to the drawings wherein like reference numerals designate like or similar parts throughout the several views there is illustrated in FIG. 1 a quick disconnect 10 which has female and male portions 12 and 14 respectively. The quick disconnect connects an electrical cable 16 to a missile 18 just prior to firing for power and control purposes. After the missile 18 is fired the quick disconnect 10 automatically disconnects the cable 16 so that the missile 18 can commence its trajectory.

As illustrated in FIG. 2 the male portion 14 of the quick disconnect may include a sleeve 20 which is mounted about an electrical receptacle 22 which in turn is connected to a cable 24. The sleeve 20 has a rearward annular shoulder 26 which has a groove 28. Forward of the shoulder 26 is another annular shoulder 29 which receives an O-ring 30. Between the shoulder 26 and the shoulder 29 are a plurality of pins 32 for a purpose to be described hereinafter.

As shown in FIG. 5, the female portion 12 of the quick disconnect includes inner, outer, and middle concentric sleeves 34, 36, and 38 respectively which are slidable with respect to one another. A grounding sleeve 40 may be threaded into the middle sleeve 38. The electrical plug pin assembly 41 can be removed when the grounding sleeve 40 is unthreaded from the female portion 12 of the quick disconnect.

The middle sleeve 38 has a rearwardly reduced outer diameter to provide an annular space 42 between the middle and the outer sleeves 38 and 36. A compression spring 44 is mounted within the annular space 42 for urging the outer sleeve 36 forwardly with respect to the middle sleeve 38. The means for retaining the spring will be described in detail hereinafter.

The outer sleeve 36 is counterbored at a forward end 46 so as to receive balls 48 which are radially slidable within apertures 50 in the middle sleeve 38. The middle sleeve 38 is counterbored at 52 to receive a compression spring 54 for urging the inner sleeve 34 forwardly to open and close said apertures 50. When the inner sleeve 34 is pushed rearwardly, as illustrated in FIG. 3, the balls 48 drop inwardly and release the outer sleeve 36 from the middle sleeve 38.

The outer sleeve 36 is integral with a bracket 56 which in turn is connected to a launcher mount 58 (see FIG. 1). After the missile is fired, a spring biased pin 60 rides downwardly on the mount 58 to snap into a pair of bottom located notches 62, one of which is illustrated in FIG. 1. The middle sleeve 38 of the female portion of the quick disconnect is provided with forwardly located notches 64 (see FIGS. 2, 7, and 10) at varying angles so as to receive in a polarized relationship the pins 32 on the male portion of the plug. This polarization is mandator for proper pin to socket engagement and missile operation.

As illustrated in FIG. 2 the male portion 14 is completely disconnected from the female portion 12. As illustrated in FIG. 3 the rearward shoulder 26 of the male portion of the quick disconnect has pushed the inner sleeve 34 rearwardly so as to drop the balls 48 within the annular groove 28 of the male portion. This operation frees the movement of the outer sleeve 36 so that the spring 44 will force this sleeve rapidly in a forward direction to seal across the O-ring 30 of the male portion 14 of the quick disconnect. Upon the missile being fired the male portion 14 of the quick disconnect is pulled forwardly while the outer sleeve 36 of the female portion of the quick disconnect is retained in place by the bracket 56. This operation causes the male portion to pull the balls 48 and the middle sleeve 38 forwardly until the balls slip into the counter bore 46 of the outer sleeve 36, at which time the inner sleeve 34 snaps forwardly across the apertures 50 to retain the balls 48 in their outward positions. The male portion of the quick disconnect is thus disconnected from the female portion thereof.

In repeated operations of the quick disconnect 10 the female portion inevitably requires refurbishment. An O-ring 66 is provided between the middle and the outer sleeves 38 and 36 which often has to be replaced. Occasionally, the balls 48 and the spring 44 will also need replacement. Further, it is desirable to periodically furnish all surfaces between the middle and outer sleeves 38 and 36 with fresh lubrication. In previous models of this disconnect such refurbishment was not practical, and required the replacement of the entire female portion of the assembly. The present invention has overcome this problem by enabling complete removal of the outer sleeve 36 from the remainder of the assembly so as to accomplish the desired refurbishment.

Accordingly, the improvement provided by this invention to the female portion of the aforementioned quick disconnect includes means 68 located within a rear portion of the annular space 42 and releasably connected to the middle sleeve 38 for stopping rearward movement of the compression spring 44. The improvement further includes means 70 located within a forward portion of the annular space 42 and releasably connected to the outer sleeve 36 for stopping forward movement of the compression spring 44. Both stop means 68 and 70 are removable rearwardly from the annular space 42 when released from their respective sleeves. As illustrated in FIG. 10, the means 68 may include a ring which has a plurality of apertures 72 for receiving pins 74 and 76. The top pin 74 is somewhat shorter than the bottom pair of pins 76. The outer sleeve 36 is provided with longitudinally extending slots 78 which are adapted to align with the bottom pair of the ring aperture 72 so as to receive the longer pins 76 therethrough. The pins 76 extend into the slots 78 so that the outer sleeve 36 and the middle sleeve 38 are properly oriented for polarization of the electrical plug 41 with the electrical receptacle 22. The top portion of the outer sleeve 36 does not have any slot opposite the aperture 72 and the pin 74 so that there can be no mistake in the polarized alignment of the parts.

The forward stop means 70 is an internal retainer ring which snaps within an internal annular groove 80 within the outer sleeve 36. It is important that the annular space 42 be deep enough for retraction and removal of the internal retainer ring 70 by a retainer ring tool (not shown).

Refurbishment of the female portion 12 of the quick disconnect is accomplished by removal of the bottom pair of pins 76 through the slots 78. The middle sleeve 38 is then rotated until the top pin 74 is aligned with one of the bottom pair of slots 78 so that pin 74 can also be withdrawn. The compression spring 44 will then force the ring 68 rearwardly from the annular space 42 so that both the ring 68 and the spring 44 can be removed. The annular space 42 is then freed for insertion of a retainer ring tool (not shown) for squeezing the internal retainer ring 70 inwardly for removal of the retainer ring from the annular space 42. The inner sleeve 34 is then pushed rearwardly to drop the balls 48 inwardly so that the outer sleeve 36 can be withdrawn forwardly and removed entirely from the remainder of the female portion of the quick disconnect. It should be noted that the outer sleeve 36 could not be completely removed from the assembly by moving it rearwardly because of the cabling 16. After removal of the outer sleeve 36 the O-ring 66 can then be replaced and the internal surfaces can be cleaned and lubricated. Reassembly of the components is essentially the reverse of the procedures described hereinabove.

Obviously, many modifications and variations of the present invention are possible in the light of the above teachings, and, it is therefore understood that within the scope of the disclosed inventive concept, the invention may be practiced otherwise than specifically described.

What is claimed is:

1. In the female portion of a quick disconnect of the type having inner, outer, and middle concentric sleeves which are all slidable with respect to one another, the forward ends of the sleeves being adapted to receive a male portion of the quick disconnect, the rearward end of the middle sleeve being connected to an elongated element, the middle sleeve having a rearwardly reduced diameter to provide an annular space between the middle and outer sleeves, a compression spring within said annular space for urging the outer sleeve forwardly with respect to the middle sleeve, the outer sleeve being counterbored at a forward end to receive balls which are radially slidable in apertures in the middle sleeve, the middle sleeve being counterbored to receive a spring means for urging the inner sleeve forwardly open and close said apertures and thereby drop the balls inwardly and release the outer sleeve from the middle sleeve when the inner sleeve is pushed rearwardly, the improvement comprising:

means located within a rear portion of said annular space and releasably connected to the middle sleeve for stopping rearward movement of the compression spring;

means located within a forward portion of the annular space and releasably connected to the outer sleeve for stopping forward movement of the compression spring; and both stop means being rmovable rearwardly from the annular space when released from their respective sleeves, whereby, after release and removal of the stop means, the outer sleeve can be slid forwardly and removed entirely from the middle and inner sleeves without interference by said elongated element.

2. The improvement as claimed in claim 1 including:

the forward stop means being an internal retainer ring; and the annular space being wide enough for rearwardly removal of the internal retainer ring.

3. An improvement as claimed in claim 2 including:

the quick disconnect being an electrical disconnect; and the elongated element being an electrical cable.

4. In the female portion of a quick disconnect of the type having concentric sleeves which are slidable with respect to one another, the forward ends of the sleeves being adapted to receive a male portion of the quick disconnect, the rearward end of one of the sleeves being connected to an elongated element, an annular space provided at the rearward end portions of an inner and outer adjacent pair of the sleeves, and a compression spring within the annular space for urging the adjacent sleeves longitudinally with respect to one another, the improvement comprising:

means located within a rear portion of said annular space and releasably connected to the inner adjacent sleeve for stopping rearward movement of the compression spring; and means located within a forward portion of the annular space and releasably connected to the outer adjacent sleeve for stopping forward movement of the compression spring whereby, after release and removal of the stop means, the outer sleeve can be slid forwardly and removed entirely from the inner sleeve.

5. The improvement as claimed in claim 4 including:

the quick disconnect being an electrical disconnect;

the elongated element being an electrical cable;

the forward stop means being an internal retainer ring; and the annular space being wide enough for rearwardly removal of the internal retainer ring.

* * * * *